United States Patent [19]

Barrat et al.

[11] 4,446,033

[45] May 1, 1984

[54] FABRIC CONDITIONING COMPOSITIONS CONTAINING AMINO-SILANES

[75] Inventors: Christian R. Barrat; John R. Walker, both of Brussels; Jean Wevers, Strombeek-Bever, all of Belgium

[73] Assignee: The Procter & Gamble Company, Cincinnati, Ohio

[21] Appl. No.: 421,182

[22] Filed: Sep. 22, 1982

[30] Foreign Application Priority Data

Sep. 25, 1981 [GB] United Kingdom ..... 8129070

[51] Int. Cl.[3] ..... D06M 13/34

[52] U.S. Cl. ..... 252/8.6; 252/8.8

[58] Field of Search ..... 252/8.6, 8.8, 541, 542, 252/547, 174.15, DIG. 14, 528; 556/413, 418

[56] References Cited

U.S. PATENT DOCUMENTS

| | | | |
|---|---|---|---|
| 2,971,864 | 2/1961 | Speier | 427/388 |
| 2,972,598 | 2/1961 | Morehouse | 260/46.5 |
| 3,033,815 | 5/1962 | Pike et al. | 260/46.5 |
| 3,085,908 | 4/1963 | Morehouse et al. | 427/388 R |
| 3,168,389 | 2/1965 | Eilerman | 556/413 |
| 3,175,921 | 3/1965 | Hedlund | 427/409 |
| 3,876,459 | 4/1975 | Burrill | 427/387 |
| 3,992,332 | 11/1976 | Zenon | 252/548 |
| 4,005,024 | 1/1977 | Rodriguez et al. | 252/174.15 X |
| 4,005,025 | 1/1977 | Kinstedt | 252/547 X |
| 4,005,030 | 1/1977 | Heckert et al. | 252/140 |
| 4,005,118 | 1/1977 | Heckert et al. | 252/546 |
| 4,013,573 | 3/1977 | Leikhim et al. | 252/99 X |
| 4,062,999 | 12/1977 | Kondo et al. | 428/391 |
| 4,137,179 | 1/1979 | Koerner et al. | 252/8.6 |
| 4,152,273 | 5/1979 | Weiland | 252/8.8 |
| 4,217,228 | 8/1980 | Koerner et al. | 252/8.6 |
| 4,351,736 | 9/1982 | Steinberger et al. | 252/8.6 |

FOREIGN PATENT DOCUMENTS

| | | |
|---|---|---|
| 753603 | 2/1967 | Canada . |
| 1793280 | 2/1972 | Fed. Rep. of Germany . |
| 2299447 | of 0000 | France . |
| 1207724 | 2/1960 | France . |
| 858445 | 1/1961 | United Kingdom . |

OTHER PUBLICATIONS

U.S. Ser. Nos. 421,185; 421,186; 421,187; 421,182; 421,183, Barrat et al., filed 9/22/82.

*Primary Examiner*—P. E. Willis, Jr.
*Attorney, Agent, or Firm*—Donald E. Hasse; Robert B. Aylor; Thomas H. O'Flaherty

[57] ABSTRACT

Fabric conditioning compositions containing an active component and liquid or solid diluents and furthermore a low level of amino-silane components are disclosed. Preferred executions highlight fabric softener compositions, particularly liquid rinse softener compositions. The amino-silanes provide enhanced washing machine compatibility especially in relation to enamel-coated surfaces.

6 Claims, No Drawings

FABRIC CONDITIONING COMPOSITIONS CONTAINING AMINO-SILANES

FIELD OF THE INVENTION

This invention relates to fabric conditioning compositions having improved compatibility with the machines wherein the conditioning treatment is carried out, especially to machines incorporating enamel-coated surfaces. In detail, the invention pertains to the utilization of amino-silanes in combination with fabric conditioning compositions, preferably rinse softeners or rinse additive compositions.

The claimed technology can find beneficial application in all kind of fabric conditioning compositions such as rinse softener applications, starch treatment compositions, ease-of-ironing compositions, aesthetic compositions and more in general, all kinds of compositions that can or are currently used for imparting fabric conditioning benefits. Preferred compositions embodying this technology are liquid rinse softener applications. Such softener applications can be solid or liquid and contain various ranges of active ingredients depending upon the contemplated usage conditions. The essential amino-silane component was found to be compatible to these compositions and moreover to provide remarkable compatibility to machines used for the conditioning treatment, particularly machines having enamel-coated surfaces.

BACKGROUND OF THE INVENTION

Silanes and amino-silanes are widely used in the chemical industry, mostly as coupling agents between inorganic and organic surfaces. These compounds have also found application for metal-surface protection. The protective treatment is applied from an aqueous medium, possibly from solvent systems containing lower alcohols and water, depending upon the characteristics of the silanes. Representative of this state of the art are: U.S. Pat. No. 3,085,908, Morehouse et al., U.S. Pat. No. 3,175,921, Hedlund, and French Pat. No. 1,207,724, Morehouse et al.

Quaternized amino-silanes are known, from U.S. Pat. No. 4,005,118, Heckert et al. and U.S. Pat. No. 4,005,025, Kinstedt, to be suitable for conferring soil release properties to metallic and vitreous surfaces upon application from a wash or rinse-solution. The like quaternized amino-silanes, upon incorporation in aqueous detergents, are subject to deactivation, possibly following polymerization during storage.

It is also generally known that silane metal-surface treatment is usually carried out under slightly acidic conditions (pH 3–5) in order to prevent polymerization of the silane monomers in the aqueous medium which polymerization is known to decrease the effectiveness of the surface treatment.

The preparation of a broad class of gamma-aminopropylalkoxysilanes is known from German Application DOS No. 17 93 280.

Silanes, inclusive of amino-silanes, have been used in industrial fiber treatment technology, mostly in combination with polysiloxanes. This art is represented by German Patent Application: DOS No. 27 26 108; DOS No. 14 69 324; DAS No. 23 35 751; and U.S. Pat. No. 4,152,273, Weiland.

Such known industrial fiber/substrate treatments quantitatively aim at chemically attaching, to the substrate, an organic polymer with a view to impart permanently modified fiber properties such as water-repellency, shrink-proofing, bactericidal properties, and so on. Silanes are used in a coupling/adhesion agent functionality, i.e., the silane is non-releasably affixed to the substrate. For example, a process for giving permanent shrink resistent properties to woollens as known from Belgian Pat. No. 802,311, Dow Corning, uses a mixture of organopolysiloxanes and silanes.

Treatment compositions for synthetic fibers containing amino-silanes and epoxysiloxanes are known from German Patent Application DAS No. 25 05 742, Tenijin Ltd. The treated fibers have enhanced compression-elasticity, smoothness, flexibility, softeness and good usage characteristics. The silane acts as a coupling agent for depositing the active ingredient, i.e. the silicones.

A number of textile treatment compositions inclusive of solid cleaning compositions are formulated with a view to ensure the machine surface is compatible to the treatment liquor. Frequently, this is achieved with the aid of alkaline water-soluble silicate. However, in many cleaning compositions, the like silicates could not be used because of incompatibility and other well-known formulation deficiencies. For example, those attached to liquid detergent compositions which are deficient in this respect.

There is also a standing desire to improve the machine surface, particularly the enamel-coated surfaces, to make it better compatible to the fabric conditioning operation itself and furthermore to provide some extra-protective effect which will safeguard the machine during the subsequent laundry cycle.

It is an object of this invention to provide fabric conditioning compositions which are excellently compatible to the machine wherein the conditioning treatment is carried out.

It is a further object of this invention to formulate fabric conditioning compositions capable of providing machine surface protection and coating which will exhibit its benefits during the subsequent laundry operations.

It is yet another object of this invention to provide textile rinse softening compositions capable of effectively protecting the machine during the softening treatment and also conferring additional protection during the subsequent laundry treatment.

SUMMARY OF THE INVENTION

This invention relates to fabric conditioning compositions having improved machine compatibility particularly in relation to enamel-coated surfaces. The claimed compositions contain from 1% to 95% by weight of an active fabric-conditioning component; and from 0.001% to 5% by weight of an amino-silane having the formula $$(R_1O)_{3-x}-\overset{\overset{(R_1)_x}{|}}{Si}-(CH_2)_m-N(R_3)_2$$

wherein $R_1$ = $C_{1-4}$-alkyl or $C_{1-4}$-hydroxyalkyl;

x is 0 or 1;

m is 1–6;

$R_3$ is hydrogen, $R_1$, $C_{1-6}$-alkylamine,

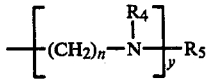

$R_4$ is hydrogen or $R_1$;
n is 1–6;
y is 0–6;
$R_5 = R_4$,

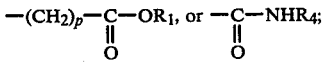

p = 1–6.
The $R_3$'s can be identical or different.

While the claimed technology can be utilized beneficially for any kind of fabric conditioning operation, it was found to be particularly suitable for use in fabric rinse softener compositions, particularly liquid rinse softener compositions in combination with variable levels of textile softening agents, most preferably cationic textile softeners.

The term "enamel" in enamel-coated is meant to embrace a vitreous opaque or transparent glaze fused over metal.

DETAILED DESCRIPTION OF THE INVENTION

It has now been discovered that fabric conditioning compositions having significantly improved machine compatibility can be formulated with the aid of specific amino-silanes. In more detail, the claimed compositions contain: a major amount of an active fabric conditioning agent, and an additive level of an amino-silane. The essential parameters, preferred executions and preferred additives are described hereinafter.

Unless stated otherwise, the "percent" indications stand for percent by weight of the composition.

The active fabric-conditioning agent can be selected from a wide variety of substances which are known to be suitable for that purpose or have been used as such. Of course, the particular selection of a specific active component has to take into consideration the particular benefits one wishes to impart and also usage conditions, type of machine, and so on. Examples of well-known textile benefits include: softening; anti-wrinkling; smoothness; ease-of-ironing; renewable textile finishing such as starching; and aesthetic treatments inclusive of bluing, whitening and perfuming. Preferred active fabric conditioning agents for use herein embrace textile softening actives that can be used beneficially in the rinse step subsequent to the laundry treatment of a washing machine. Rinse textile softening is the most common way to confer renewable textile benefits in the context of machine laundering.

Rinse textile softeners usually comprise an active softening ingredient, and optionally liquid or solid inert matrix components and additive level of further substances such as stabilizing agents, perfumes, dyes and so on.

The active softening ingredient is usually selected from the group of cationic and/or nonionic fabric substantive agents. The nonionic softening actives in addition to ethoxylates can be represented by fatty acid esters, paraffins, preferably oils, fatty alcohols and fatty acids. Examples of suitable softening ingredients include the cationic surfactants described in U.S. Pat. No. 4,128,484, column 5, line 52 to column 7, line 7, this passage being incorporated herein by reference. Hydrocarbons, branched or straight-chain, can also be used as textile softening materials in the compositions herein. Suitable hydrocarbons are found in the paraffin and olefin series but other materials such as alkynes and cyclic hydrocarbons can also be used. Examples of suitable hydrocarbon species include paraffin oil, soft paraffin wax and petrolatum. Other examples are hexadecane, octadecane, eicosane and octadecene. Preferred commercially available paraffin mixtures include spindle oil, light oil and technical grade mixtures of $C_{14}$–$C_{17}$ paraffins and $C_{18}$–$C_{20}$ paraffins. The ratio of cationic softener material to hydrocarbon in liquid rinse-softening compositions is frequently in the range from about 20:1 to about 1:5, preferably from about 10:1 to about 1:1.

Also nonionic softening agents can be used as conditioning agents in e.g. the softening embodiment of this invention. Suitable species of nonionic softeners are disclosed in U.S. Pat. No. 4,128,484, column 3, line 10 to column 5, line 49, this passage being incorporated herein by reference.

Another class of suitable fabric softening agent is represented by the polyamines of European Patent Application No. 78-200059.0, page 4, line 37 to page 6, line 27, this passage being incorporated herein by reference.

The essential amino-silane component can be used in levels from 0.001% to 5%, preferably from 0.01% to 2%. Using less than 0.001% will not anymore produce the benefits of the invention whereas the use of levels above the upper limit will not provide additional benefits. The term amino-silane as used herein stands for the free amine form and for the corresponding salts such as e.g. hydrochloride salts, hydrosulfates or methosulfates.

The amino-silane component has the formula:

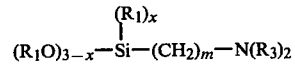

wherein:
$R_1 = C_{1-4}$-alkyl or $C_{1-4}$-hydroxyalkyl;
x is 0 or 1;
m is 1–6;
$R_3$ is hydrogen, $R_1$, $C_{1-6}$-alkylamine, or

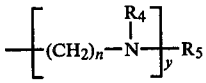

$R_4$ is hydrogen or $R_1$;
n is 1–6;
y is 0–6;
$R_5 = R_4$,

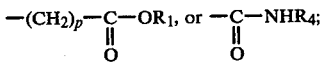

p = 1–6.
The $R_3$'s can be identical or different.

Preferred amino-silanes for use herein can carry the following substituents:
$R_1 = -CH_3$ or $-C_2H_5$
x = 0 m=2 or 3

$R_3$=hydrogen and

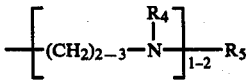

$R_4$=hydrogen or methyl $R_5$=hydrogen or methyl.

The most preferred amino-silanes have the following chemical formula:

$$(CH_3—O)_3—Si—(CH_2)_3—NH—(CH_2)_2—NH_2 \quad (a)$$

$$(CH_3—O)_3—Si—(CH_2)_3—NH—(CH_2)_3—NH_2 \quad (b)$$

$$(CH_3—O)_3—Si—(CH_2)_3—NH—(CH_2)_2—NH—(CH_2)_2NH_2 \quad (c)$$

and the salts thereof.

The above structural formulae correspond to the following chemical names:

N-(trimethoxysilylpropyl)-ethylene diamine (a)

N-(trimethoxysilylpropyl)-propylene diamine (b)

N-(trimethoxysilylpropyl)-diethylene triamine (c)

The claimed amino-silanes are easily processable in liquid softening compositions. Furthermore, the silane is well-compatible to the individual ingredients. Surprizingly, it was also found that these silanes remain effective after periods of prolonged storage.

In addition to the essential components, the compositions herein may contain adjuvents at the usual levels for their known purposes. Known examples of the like adjuvents include emulsifiers, germicides, viscosity modifiers, colorants, fungicides, dyes, stabilizers, brighteners, opacifiers, and the like. Some of these adjuvents can be used as conditioning agent, i.e., alone or in combination with other conditioning agents. The textile treatment compositions of this invention can also contain, as an optional ingredient, a silicone, as for example described in German Patent Application DOS No. 26 31 419, this reference being incorporated herein by reference.

Liquid softening compositions can arbitrarily be divided into several classes based on the variations in the level of the active softening/conditioning component. Conventional fabric rinse softening compositions frequently contain from 3–10%, preferably from 4–7% by weight of a cationic water-insoluble softening component. This category can be termed as "diluted" fabric softeners. A second category of liquid rinse softener comprises from about 12% to about 30%, preferably from 13% to 20% of the active softening component or mixtures thereof. This category of liquid softeners can be usually termed "concentrated" softeners.

The diluted and concentrated liquid softener executions in addition to the active component and additives referred to hereinbefore can comprise a solvent system, in majority water and lower alcohols selected from e.g. methyl alcohol, ethyl alcohol and isopropanol. Both the diluted and the concentrated product versions are preferably dispersions of the active in the water solvent matrix.

A third class of liquid rinse softener compositions can be termed as "super-concentrates" i.e., liquid softeners comprising e.g. from 35% to 95%, preferably from 40% to 60% of the active conditioning ingredient. Contrary to the aqueous solvent matrix in the diluted and the concentrated product forms as described hereinbefore, the super-concentrates are based on organic solvent matrixes such as low alcohols inclusive of isopropanol, organic ethoxylates, polyglycols and other known comparable solvents. Additive levels of water may be present, i.e., more that 50% of the solvent matrix is comprised of organic components.

The level of the amino-silane component varies usually in relation to the level of the active phase, i.e., amino-silane levels in a level from 0.01% to 1% are used in diluted product form, 0.1% to 2% are used in concentrated product form whereas the super-concentrates can require from e.g. 0.2% to 5% of the amino-silanes. The amino-silanes can be easily incorporated in the executions of this invention, particularly, the liquid softening executions. Preferably the amino-silane can be pre-dispersed in the organic phase such as the cationic softener, the paraffin oil or the nonionic softener whereafter the silane-containing permix is dispersed in the water seat in accordance with known preparational techniques. It is understood that diluted executions are prepared starting from an aqueous seat whereas concentrates can require a seat containing a mixture of water and organic solvents whereas the liquid seat for super-concentrates is comprised of a majority of organic constituents.

The following examples highlight the invention and illustrate its understanding.

EXAMPLE I

Liquid softening concentrates were prepared by mixing the following ingredients.

| | COMPOSITION (% by weight) | |
|---|---|---|
| | A | I |
| Ditallowdimethylammonium chloride | 13 | 13 |
| Glycerolmonostearate | 3 | 3 |
| Tallowamine 2 times ethoxylated | 1 | 1 |
| Pre-emulsified silicone (Dow Corning DC346) | 0.3 | 0.3 |
| N—(trimethoxysilylpropyl)-ethylene diamine | — | 0.1 |
| Miscellaneous inclusive of dyes, perfume, $CaCl_2$, bactericide and water | balance to 100 | |

The composition of liquid softeners A and I were used at a level of 40 g. in the last rinse of a textile laundering operation carried out in a MIELE 422 machine. The detergent used during the wash, a commercial liquid detergent, which was free of alkaline silicates. A boilwash (90° C.) laundry cycle was used. The washing machine was loaded with 3 kg. clean cotton and enamel-coated plates protected from physical contact with the machine surfaces but in contact with the laundry liquor. Enamel weight lossess was recorded and translated into a corrosion index (ECI) as follows:

$$\frac{\text{enamel weight loss observed with Composition I}}{\text{enamel weight loss observed with reference Composition (A)}} \times 100 = ECI$$

The comparative results after 12 consecutive cycles were:

| COMPOSITION | ECI |
|---|---|
| A | 100 |
| I | 28 |

Further softening compositions are prepared as follows.

| INGREDIENTS | EXAMPLES II | III | IV | V | VI |
|---|---|---|---|---|---|
| Ditallowdimethylammonium chloride | 5,5 | 3,5 | 13 | | |
| Glycerol monostearate | | 15 | 3 | | |
| N—tallow-N,N',N'—tri(2-hydroxyethyl)-1,3 propane diamine dihydrochloride | | | 1 | | |
| 1-methyl-1-(tallowylamido) ethyl-2-tallowyl-4,5-dihydroimidazolinium methosulfate | | | | 13 | 50 |
| $C_{13}$–$C_{17}$-n-paraffin | | | | 12 | |
| Nonylphenol 3 times ethoxylated | | | | | 35 |
| Ethanol | | | | | 4 |
| Isopropanol | 1,0 | | 2 | 2 | 10 |
| N—(trimethoxysilylpropyl)-ethylene diamine | 0,005 | | 0,3 | | |
| N—(trimethoxysilylpropyl)-propylene diamine | | | | 0,4 | |
| N—(trimethoxysilylpropyl)-diethylene triamine | | 0,06 | | | 1 |

We claim:

1. A fabric conditioning composition, preferably a liquid rinse softener composition, suitable for use in washing machines comprising from 1% to 95% by weight of active fabric conditioning agents; and from 0.001% to 5% by weight of an amino-silane having the formula

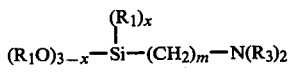

wherein:

$R_1$=$C_{1-4}$-alkyl or $C_{1-4}$-hydroxyalkyl;

x is 0 or 1;

m is 1–6;

each $R_3$ is hydrogen, $R_1$, $C_{1-6}$-alkylamine, or

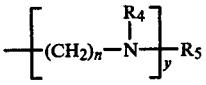

$R_4$ is hydrogen or $R_1$;

n is 1–6;

y is 0–6;

$R_5$=$R_4$,

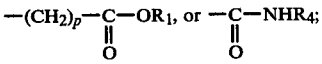

p=1–6.

2. The composition in accordance with claim 1 wherein the substituents of the amino-silane are as follows:

$R_1$=—$CH_3$ or —$C_2H_5$, x=0 m=2 or 3

$R_3$=hydrogen and

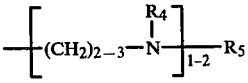

$R_4$=hydrogen or methyl $R_5$=hydrogen or methyl.

3. The rinse softening composition in accordance with claim 1 wherein the conditioning agent is a cationic and/or nonionic fabric substantive softening agent which is present in an amount of from 3% to 10% by weight and wherein the amino-silane is present in an amount of from 0.01% to 1% by weight.

4. The rinse softening composition in accordance with claim 1 wherein the conditioning agent is a cationic and/or nonionic fabric substantive softening agent which is present in an amount of from 12% to 30% by weight and wherein the amino-silane is present in an amount of from 0.01% to 2% by weight.

5. The rinse softening composition in accordance with claim 1 wherein the conditioning agent is a cationic and/or nonionic substantive softening agent which is present in an amount of from 35% to 95% by weight and wherein the amino-silane is present in an amount of from 0.2% to 5% by weight.

6. The fabric conditioning composition in accordance with claim 1 wherein the amino-silane is:

N-(trimethoxysilylpropyl)-ethylene diamine

N-(trimethoxysilylpropyl)-propylene diamine or

N-(trimethoxysilylpropyl)-diethylene triamine.

* * * * *